US006238539B1

(12) United States Patent
Joyce et al.

(10) Patent No.: US 6,238,539 B1
(45) Date of Patent: May 29, 2001

(54) METHOD OF IN-SITU DISPLACEMENT/STRESS CONTROL IN ELECTROPLATING

(75) Inventors: Richard J. Joyce, Thousand Oaks; Ronghua Wei, Calabasas; Randall L. Kubena, Agoura; Robert E. Doty, El Segundo, all of CA (US)

(73) Assignee: Hughes Electronics Corporation

( * ) Notice: Subject to any disclaimer, the term of this patent is extended or adjusted under 35 U.S.C. 154(b) by 0 days.

(21) Appl. No.: 09/344,729

(22) Filed: Jun. 25, 1999

(51) Int. Cl.[7] ..... C25D 21/12
(52) U.S. Cl. ..... 205/84; 204/228.7
(58) Field of Search ..... 205/82, 83, 84; 204/228.7, 228.6

(56) References Cited

U.S. PATENT DOCUMENTS

| | | | | |
|---|---|---|---|---|
| 2,895,888 | * | 7/1959 | Varner | 205/84 |
| 4,648,944 | * | 3/1987 | George et al. | 205/82 |
| 4,786,376 | * | 11/1988 | Vaaler | 205/67 |
| 4,986,130 | * | 1/1991 | Engelhaupt et al. | 73/760 |
| 5,665,253 | | 9/1997 | Kubena et al. | 216/41 |
| 6,080,288 | * | 6/2000 | Schwartz et al. | 204/224 R |

OTHER PUBLICATIONS

Ashruf, C.M.A., et al., "Strain Effects in Multi–Layers," Spie, vol. 3223, 1997 pp. 149–159. No month avail.

Cairns, H.A., et al., "Potential Limitations of Conventional Photomask to Inherent Internal Stress—The Need for an Alternative Opaque Layer," Mat. Res. Soc. Symp. Proc., vol. 356, 1995, pp. 239–244. No month available.

Deni, J.W., "Stress," Electrodeposition, Noyce Publications, New Jersey, 1993, pp. 279–303. No month available.

Kushner, Joseph B., "Stress in Electroplated Metals," Metals in Progress, Feb. 2, 1992, United States.

Brenner, A. and Senderoff, S., "Calculation of Stress in Electrodeposits from the Curvature of a Plated Stip," U.S. Department of Commerce, National Bureau of Standards, Research Paper RP 1954, vol. 42, Feb. 1949* Copy ordered, will be forwarded upon receipt.

* cited by examiner

*Primary Examiner*—Kathryn Gorgos
*Assistant Examiner*—Wesley A. Nicolas
(74) *Attorney, Agent, or Firm*—V. D. Duraiswamy; M. W. Sales

(57) ABSTRACT

The dominant physical parameter that affects the internal stress of electroplated metals on substrates have been identified and their effects have been systematically studied. Thin electroplated metals have very high internal stresses, even though the substrate displacements are small. Increasing the electroplated metal's thickness greatly reduces the magnitude of the stress, which can be either tensile or compressive depending on the plating conditions, but it may not necessarily reduce the displacement of the substrate. Based on the research done in connection to this application, the relationship between the plating temperatures and the current density needed to obtain near-zero-stress state for electroplated nickel on silicon substrate can be deduced.

11 Claims, 5 Drawing Sheets

METHOD OF IN-SITU DISPLACEMENT/ STRESS CONTROL IN ELECTROPLATING

BACKGROUND OF THE INVENTION

1. Field of the Invention

The present invention relates to methods for controlling the evolution of stress during an electroplating process.

2. Description of Related Art

In an electroplating process, a particular phenomenon occurs in that all electroplated metals tend to shrink or expand relative to their substrate during or after the plating process. Electroplated metals that are under tensile or compressive stresses may: peel and crack, and create non-uniform plated sections causing dimensional instability of electroformed sections and increase vulnerability to corrosive attack. Thus, in general, stress in electroplating is undesirable.

Stress is of especially a great concern in micro-electro-mechanical systems such as micro sensors and microelectronics. Examples of micro sensors are accelerometers and glyoscopes which, are used in applications including but not limited to aerospace and automotive. Due to the high precision required in these systems, any stress at the electroplated metal will have a pronounced effect.

In 1958, Joseph B. Kushner, a professor of Engineering at Evansvile College, Indiana, conducted research of the principal factors affecting plating stresses including plating temperature, film thickness, plating current density, and the influence of contaminants. Related to his research, Joseph B. Kushner published an article entitled Stress in Electroplated Metals in a trade journal called Metal Progress, on Feb. 22, 1962. His research results showed that all electroplated metals shrink or expand relative to their substrate during or after the plating process. This, in fact, is due to tensile or compressive stresses. In his case study of rhodium plating, the tensile stress developed ran as high as 100,000 psi. Experimenting with deposit thicknesses, he found that with the exception of the initial stage of deposition, tensile stress decreases as the deposition thickness increases.

A complete description on the subject of metal stresses is beyond the scope of the specification. For details, and for an extensive bibliography of references on metal stresses, see J. W. Deni, *Stress*, published in a book entitled Electrodeposition by Noyce Publications of New Jersey in 1993.

A commonly known equation used in the electroplating industry is the Stoney Equation. The Stoney Equation calculates the average stress in an electroplated metal. The equation is as follows:

$$\text{Average Stress} = \frac{1}{3}\frac{E}{(1-V)}\frac{T_s}{r^2}\frac{h}{T_f}$$

where

E is the Young's modules of the substrate,

V is the Poisson's ratio of the substrate,

T, is the thickness of the substrate, r is the radius of the wafer, h is the displacement of the wafer at the center, and $T_f$ is the thickness of the film.

A positive stress represents the tensile stress while negative stress implies the compressive stress in the electroplated metals. A further explanation of the Stoney equation can be found in the following publications: C. M. A. Ashruf, P. J. French, C. de Boer and P. M. Sarro, "Strain Effects in Multi-Layers," SPIE Vol. 3223, 1997, pp. 149–159; J. A. Cairns, C–H. Liu, A. C. Hourd, R. P. Keatch and B. Lawrenson, "Potential Limitations of Conventional Photomask to Inherent Internal Stress The Need for an Alternative Opaque Layer," Mat. Res. Soc. Symp. Proc., Vol. 356, 1995, pp. 239–244; and A. Brenner and s. Senderoff, "Calculation of Stress in Electrodeposits for the Curvature of a Plated Stip," U.S. Department of Commerce, National Bureau of Standards, Research Paper RP1954, Vol. 42, February 1949.

A method for controlling stress induced by electroplating is known in the prior art, being disclosed in U.S. Pat. No. 4,648,944 to Ronald George, et al. Specifically disclosed is a monitoring system consisting of a strain gauge, a strain gauge monitor, several DC current regulated programmable power supplies, and a computer controlling the power supplies. The method of the prior art has disadvantages, including the following:

1. A dummy part and a second setup are being used for measuring and data gathering purposes instead of using the actual part being electroplated. Thus, an actual part that uses a different shape or a different material from the dummy part will cause errors.
2. A strain gauge is needed to be glued onto the substrate being measured.
3. The strain gauge glued onto the substrate will destroy the substrate being measured;
4. The strain gauge has low sensitivity and is inherently imprecise due to its mechanical nature;
5. The cathode on the dummy part and the second setup needs to be replaced after each run. Thus, the material cost is higher.
6. High part content because an additional cathode and an additional power supply is needed for the dummy part and second setup; and
7. High system cost due to high part content.

Somewhat related to this application is Kubona et al., U.S. Pat. No. 5,666,253, Method of Manufacturing Single Wafer Tunneling Sensor. The patent discloses a method of photo lithographically fabricating a unitary structure sensor on a semiconductor substrate. A cantilever beam is formed on the substrate, while the centilever beam has a nickel plating. It is through the process of electroplating nickel on the cantilever beam that the problem of metal stress was investigated.

Thus, there is a need for a method of in-situ displacement/stress control in electroplating that avoids the disadvantages of the prior art. The specific need is to have a more accurate measurement of the displacement of the substrate instead of the usage of a dummy part. In addition, the need to have a lower system cost by reducing unnecessary or redundant components.

SUMMARY OF THE INVENTION

The present invention provides a method for controlling electroplated metal stresses occurring in electroplating. It employs a closed-loop current and temperature control so a near-zero stress state in the electroplated material can be achieved. In one aspect of the invention, the method includes the operation of an apparatus containing a substrate for electroplating, a plating material, a displacement sensor system, a closed-loop control system, a fountain plating system, a power supply, a temperature control system, displacement data signals, a feedback input, current density control signals, power supply control signals, and temperature control signals.

The closed-loop control system has 2 portions: a feedback portion and a control portion. The fountain plating system can include a thermometer, apparatus for placing the substrate for electroplating, the plating material, and plating solution. The substrate for electroplating is placed in the fountain plating system. A cathode is attached to the substrate for electroplating. A plating material is also placed in the fountain plating system at a fixed distance from the substrate for electroplating. An anode is attached to the plating material. A displacement sensor of the displacement measurement system is positioned at a fixed distance from the substrate located within the fountain plating system.

The displacement sensor generates displacement data signals. The closed-loop control system receives the displacement data signals. The displacement data signals constitute the feedback portion of the closed-loop control system. The closed-loop control system generates at least one control signal comprising one or two of the following signals: a current density control signal and/or a temperature control system control signal.

A power supply is coupled between the closed-loop control system and the fountain plating system. The closed-loop control system generates current density control signals and controls the current density output of the power supply. The power supply is coupled between the cathode and the anode. A temperature control system is coupled between the fountain plating system and the closed-loop control system. The closed-loop control system generates temperature control signals and controls the temperature output of the temperature control system to the fountain plating system.

In processing the data from the displacement sensor system, the closed-loop control system maintains the desired current density to the cathode and the anode by controlling the power supply accordingly. The closed-loop control system maintains the desired temperature of the fountain plating system by transmitting a temperature control signal to the temperature control system. The closed-loop control system may be programmed to fix the temperature of the fountain plating system to a constant and varying the current density to the fountain plating system. In addition, the closed-loop control system may be programmed to terminate plating when a desired electroplated metal thickness has been obtained.

In another aspect of the invention, the current density is constant and the temperature is variable. The closed-loop control system is programmed to maintain the power supply to generate a constant current density feeding to the cathode and anode. The closed-loop control system adjusts the temperature of the fountain plating system by controlling the temperature control system through the temperature control signal.

In another aspect of the invention, the current density and the temperature are both variables. The closed-loop control system adjusts the level of current density and the temperature to the plating system in accordance to the displacement data for the purpose of trying to achieve a near zero-stress level.

BRIEF DESCRIPTION OF THE DRAWINGS

These and other features, aspects, and advantages of the present invention will become better understood with reference to the following description, appended claims, and accompanying drawings, where:

DESCRIPTION OF THE PREFERRED EMBODIMENT

The present invention relates to the process for on-the-part stress control for electroplating. Specifically, this invention discloses methods and apparatuses for monitoring the displacement of a substrate being electroplated, controlling current density, controlling temperature, and controlling the thickness of the metal deposited film for the overall purpose of monitoring and controlling stress on the electroplated metals during and after electroplating.

Figure 1:
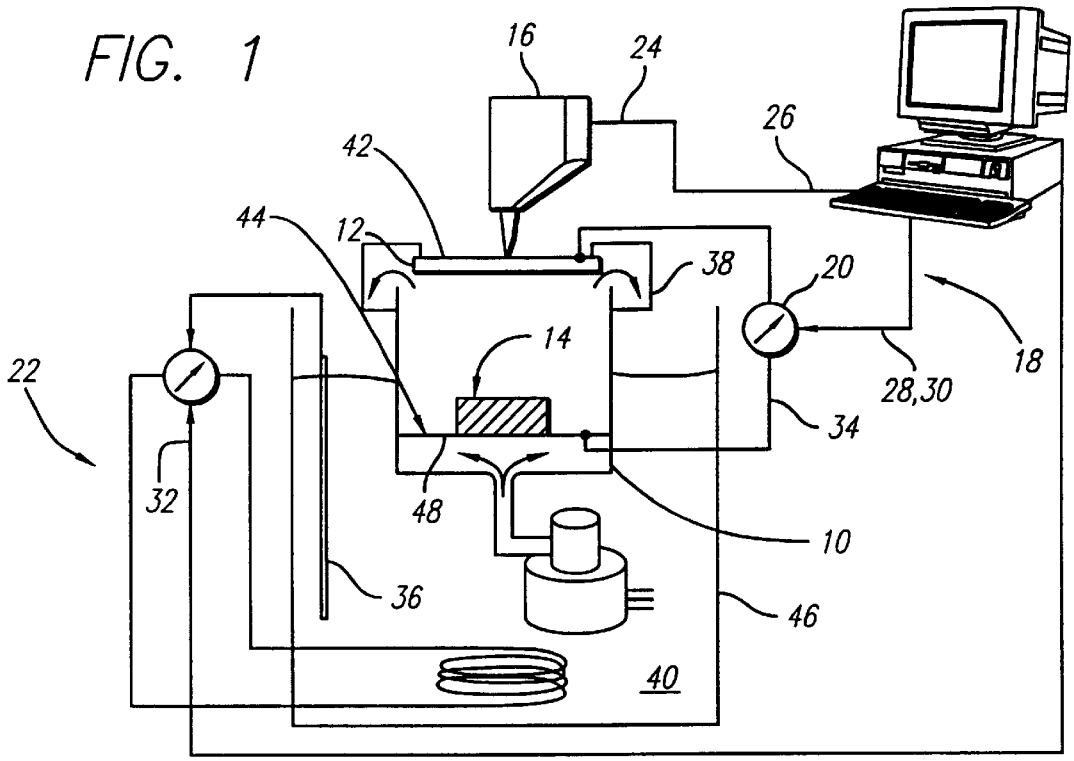
FIG. 1 is a block diagram of an apparatus for controlling an electroplating process in accordance with a preferred embodiment of the invention.

Referring to FIG. 1, there is shown an apparatus for controlling the electroplated metal stress. The apparatus of FIG. 1 has been successfully used to electroplate nickel on silicon wafers. The apparatus of FIG. 1 shows a fountain plating system 10, a plating solution container 46, a substrate 12 for electroplating, a plating material 14, a cathode 42, an anode 44, a mesh 48, a displacement sensor 16, a closed-loop control system 18, a power supply 20, a temperature control system 22, displacement data signals 24, a feedback input 26, current density control signals 28, power supply control signals 30, temperature control system control signals 32, current density 34, a thermometer 36, a substrate holder 38, and plating solution 40. The fountain plating system 10 used herein was manufactured by Marks & Associates. The displacement sensor 16 used herein was a Keyence CCD Laser Displacement Measurement System (sensor model no. LK-031, control module LK-2001, and RD50E readout).

Reviewing FIG. 1 and in accordance to the present invention, a container 46 forms the basis of the plating system 10. The plating solution container 46 holds a plating solution 40. The plating solution 40 is of a type known to those skilled in the art. Nickel sulfamate is used in this embodiment. A plating material 14 is placed on the top of a mesh 48 lying at the bottom of the plating system 10 to serve as the anode 44. The plating material used herein is nickel. A substrate 12 is fixed in place within the fountain plating system 10 by a substrate holder 38. The substrate 12 used in this embodiment is silicon. One side of the substrate 12 is metalized with titanium and gold.

The fountain plating system 10 can include a thermometer 36, a substrate holder 38 for holding the substrate for electroplating, the plating material 14, and plating solution 40. The plating material 14 is placed in the fountain plating system 10. The substrate 12 for electroplating is also placed in the fountain plating system 10 at a fixed distance of approximately 8 to 10 centimeters from the plating material 14 for this embodiment. The displacement sensor 16 is positioned at a fixed distance of approximately 2 to 4 centimeters from the back side of the substrate 12 for electroplating.

The cathode 42 is attached to the substrate 12 for electroplating. The anode 44 is attached to the plating material 14. The displacement sensor system 16 generates displacement data signals 24. The closed-loop control system 18 receives the displacement data signals 24 at its feedback input 26 into the closed-loop control system 18. The closed-loop control system 18 generates at least one control signal, which comprises a power supply control signal 30 and a temperature control system control signal 22.

A power supply 20 is coupled between the closed-loop control system 18 and the cathode 42 and the anode 44. The closed-loop control system 18 generates current density control signals 20 to the power supply 20 for varying the current density 34 to the cathode 42 and anode 44.

Optionally, a temperature control system 22 is coupled between the closed-loop control system 18 and the fountain plating system 10. The closed-loop control system 10 generates temperature control system control signals 32 for varying the temperature of the fountain plating system 10.

Figure 2:
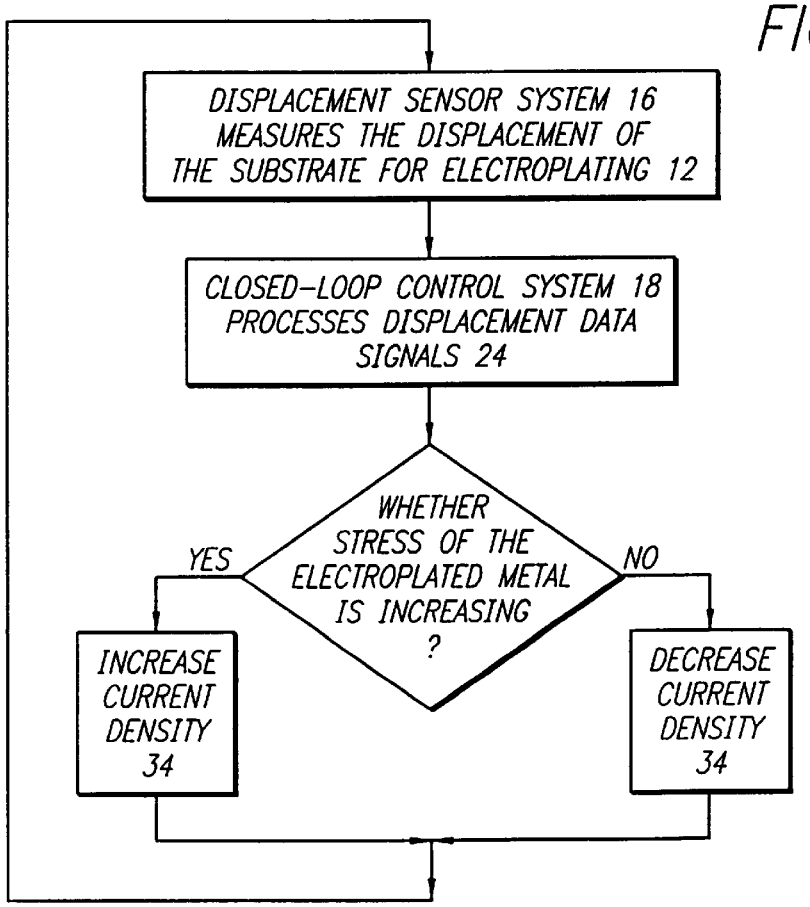
FIG. 2 is a flow chart of a closed-loop current density control for controlling electroplated metal stress according to one embodiment of the present invention.
Figure 3:
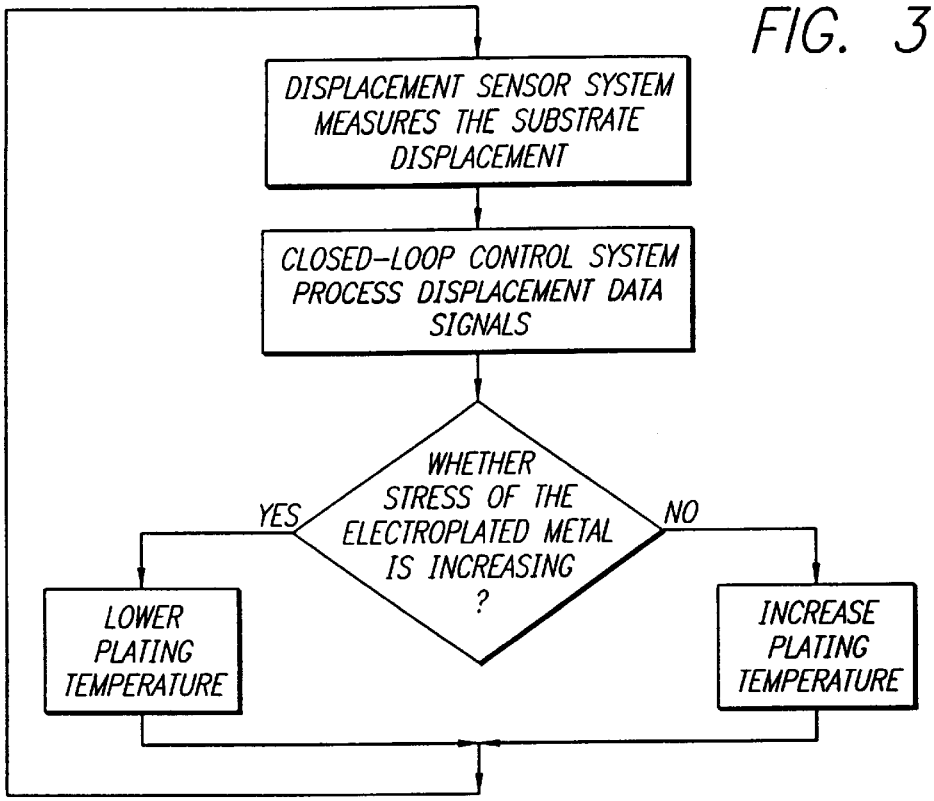
FIG. 3 is a flow chart of a closed-loop temperature control for controlling electroplated metal stress according to another embodiment of the present invention.
Figure 4:
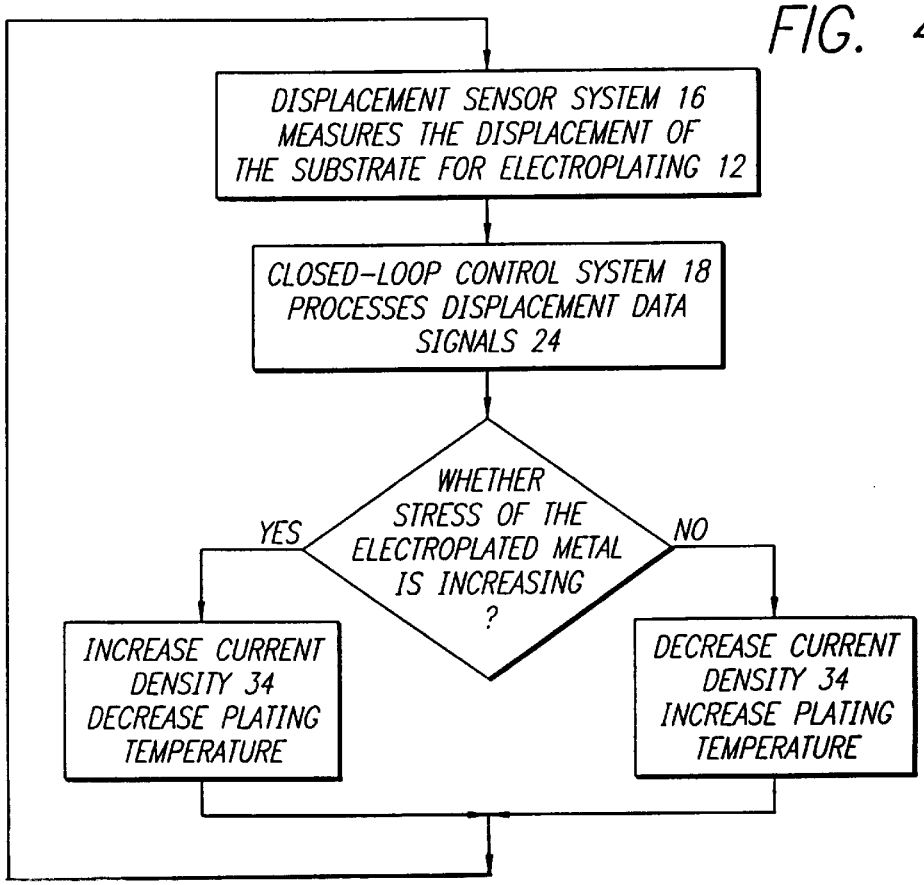
FIG. 4 is a flow chart of a closed-loop concurrent current density and temperature control for controlling electroplated metal stress according to yet another embodiment of the present invention.

The methods of closed-loop current density and temperature controls are exemplified in FIGS. 2, 3, and 4.

Closed-loop Current Density Controlled Method

FIGS. 1 and 2 show an apparatus and a method for a rear null stress electroplating process employing the closed-loop current density controlled method. The displacement/stress control is accomplished by varying the plating current density. Plating parameters such as temperature, current density and film thickness have strong effects on the stress. It is easier to adjust the current density than adjusting the plating temperature because of more precision and better response time. Typically, a plating temperature is selected prior to the plating run and maintained during plating, and only the current density is adjusted to achieved the displacement/stress control. Exemplified in FIGS. 1 and 2, the displacement sensor system 16 measures the displacement data signal 24 to the closed-loop control system 18. The displacement data signal 24 is processed by the closed-loop control system 18 and it determines whether the electroplated metal stress is increasing or decreasing. If the stress is increasing, the closed-loop control system 18 increases the current density 34 of the power supply 20 to the cathode 42 and the anode 44. Conversely, if the displacement of the substrate 12 for electroplating is decreasing, the closed-loop control system 18 decreases the current density 34 of the power supply 20. From empirical data, the preferred range of current density is about 1.25 $mA/cm^2$ in this embodiment.

Closed-loop Temperature Controlled Method

FIGS. 1 and 3 show an apparatus and a method for a near null stress electroplating process employing the closed-loop temperature controlled method. Exemplified in FIGS. 1 and 3, the displacement sensor system 16 measures the displacement of the substrate 12 for electroplating and generates displacement data signals 24 to the closed-loop control system 18. The displacement data signal 24 is processed by the closed-loop control system 18 and it determines whether the stress of the electroplated metal is increasing or decreasing. If the stress is increasing, the closed-loop control system 18 lowers the plating temperature by transmitting temperature control system control signals 32 to the temperature control system 22. If the displacement of the substrate 12 for electroplating is decreasing, the closed-loop control system 18 increases the plating temperature by transmitting temperature control system control signals 32 to the temperature control system 22. In this embodiment, the preferred temperature range is about 22° C. to 70° C. as a result of empirical data.

Closed-loop Concurrent Current Density and Temperature Controlled Method

FIGS. 1 and 4 show an apparatus and a method for a near null stress electroplating process employing the concurrent closed-loop current density and temperature controlled method. Exemplified in FIGS. 1 and 4, the displacement sensor system 16 measures the displacement of the substrate 12 for electroplating and transmits displacement data signals 24 to the closed-loop control system 18. The displacement data signals 24 are processed by the closed-loop control system 18 and it determines whether the stress of the electroplated metal is increasing or decreasing. If the stress of the electroplated metal is increasing, the closed-loop control system 18 increases the current density 34 to the cathode 42 and the anode 44. It also lowers the plating temperature by transmitting power supply control signals 30 to the power supply 22 and temperature control system control signals 32 to the temperature control system 22. If the stress of the electroplated metal is decreasing, the closed-loop control system 18 decreases the current density 34 and increases the plating temperature by transmitting power supply control signals 30 to the power supply 22 and temperature control system control signals 32 to the temperature control system 22.

The preferred range of currently density is about 1.25 $mA/cm^2$ to 5.0 $mA/cm^2$. The preferred range of temperature is about 22° C. to 70° C.

in addition, the closed-loop control system 18 may be programmed to terminate plating when an optimal deposition thickness has been obtained. Typically, an optimal deposition thickness is obtained when the internal metal stress is minimal and has reached a fixed constant. The desired deposition thickness can be obtained through the readout from the displacement sensor system 16 and the closed-loop control system 18.

EXAMPLES

The Effect of Plating Temperature

A number of silicon wafers were plated with nickel under the following experimental conditions: the temperature was varied from 22° C.–70° C. and four current densities were used: 0.31, 0.63, 1.25, and 2.14 $mA/cm^2$. The experimental results were plotted and shown in FIG. 5.

Figure 5:
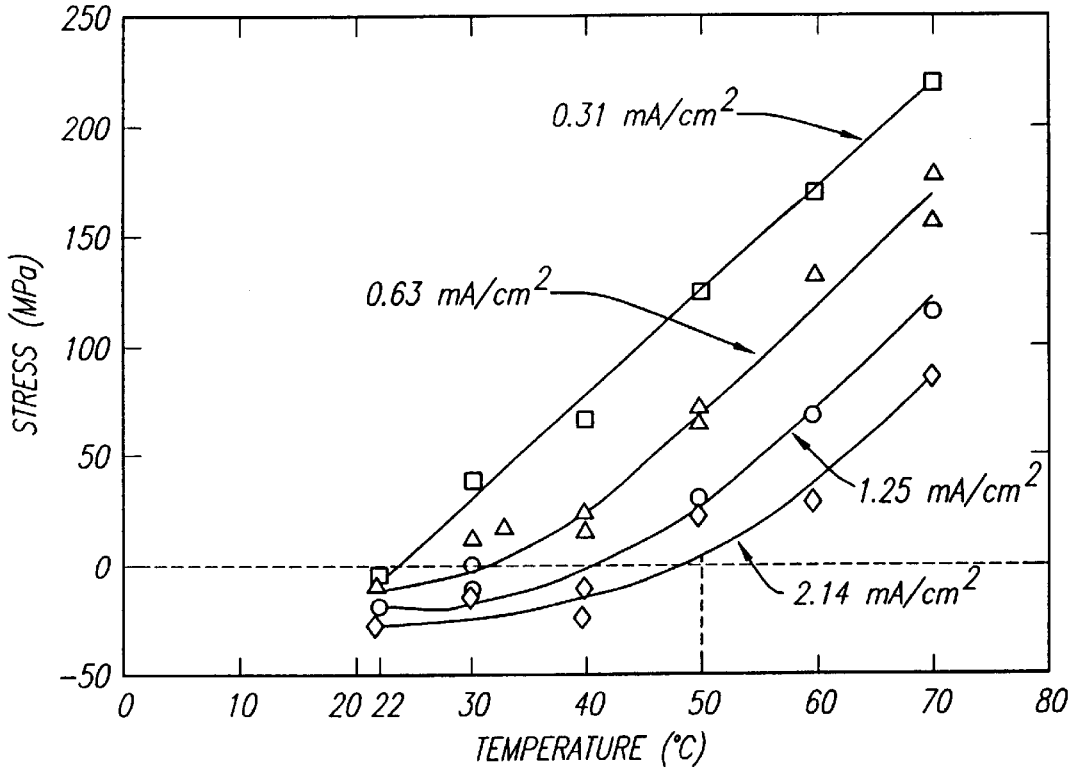
FIG. 5 is a graph of the experimental results of stress vs. plating temperature using nickel as the plating material and silicon as the substrate according to the present invention.

FIG. 5 shows that stress is a function of plating temperature. At high temperature, the stress is high; while at low temperatures, the stress is low. Furthermore, for a given current density, the stress linearly increases with the temperature. However the stress barely changes with the decrease of the temperature on the compressive side (below zero).

The Effect of Current Density

Figure 6:
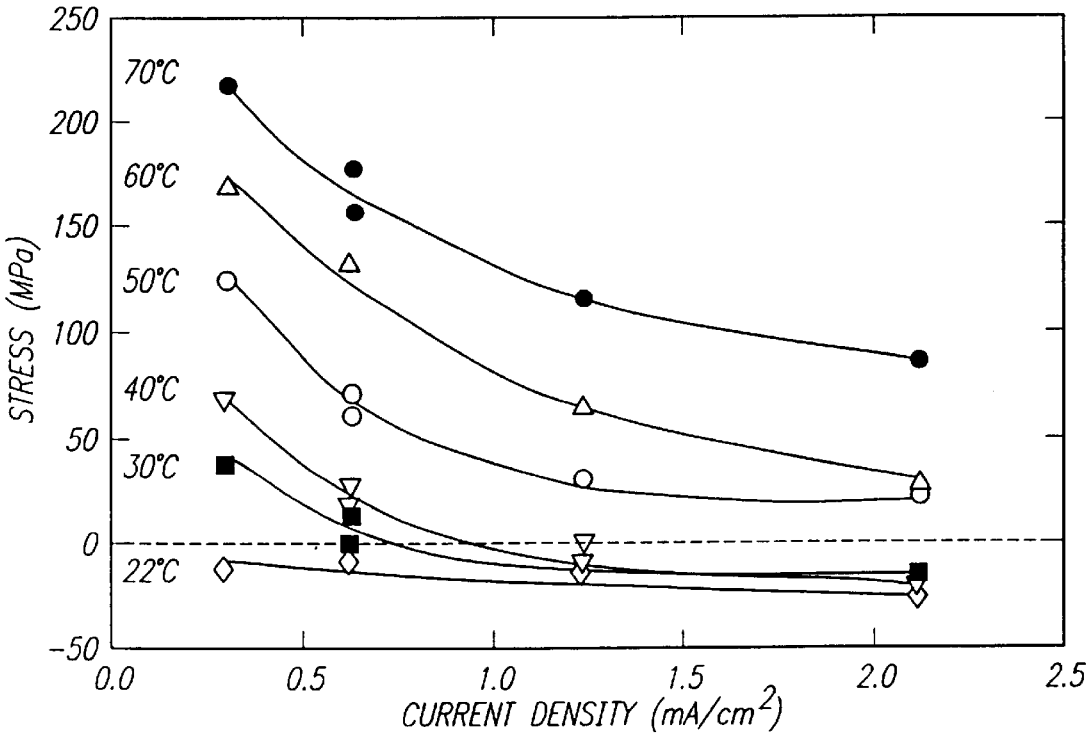
FIG. 6 is a graph of the experimental results of stress vs. current density using nickel as the plating material and silicon as the substrate according to the present invention.

Using the same parameters used in FIG. 5, the effect of the plating current density can also be seen. The results are plotted and shown in FIG. 6. In FIG. 6, an increase in the current density results in decrease of the electroplated metal stress.

The Effect of Electroplated Material Thickness

The effect of electroplating material thickness on the stress was investigated by placing a few silicon wafers under several plating conditions. In each plating condition, current density and temperature were fixed. The resultant stresses were plotted and shown here in FIG. 7. As can be seen, for thinly electroplated film, the stress is very high. This is consistent with the Stoney equation in that the thickness of the electroplated metal $T_f$ is in the denominator of the equation. Thus, increasing $T_f$ increases the overall denominator value, thus, resulting in the decrease of stress.

Figure 7:
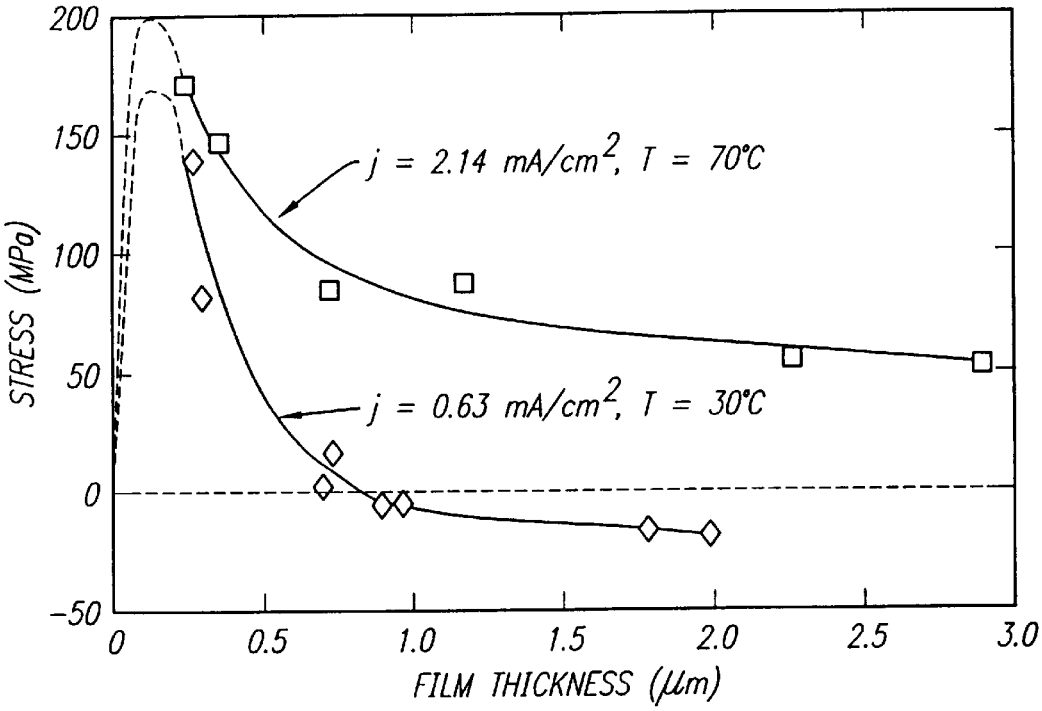
FIG. 7 is a graph of the experiment results of stress vs. electroplated metal thickness according to the present invention.

However, this assumption does not carry through all conditions. A careful review of FIG. 7 shows that initially, increasing the electroplated metal thickness ($T_f$) actually increases stress instead of decreasing it. The Stoney equation shows that stress is proportional to substrate displacement but inversely proportional to the electroplated metal's thickness ($T_f$). Since the thickness of the electroplated metal is very thin at the very beginning of the plating process, the stress will be high even if the substrate displacement is small. Later during the plating process, the electroplated metal's thickness increases faster than the substrate displacement, which results in decreased stress.

Figure 8:
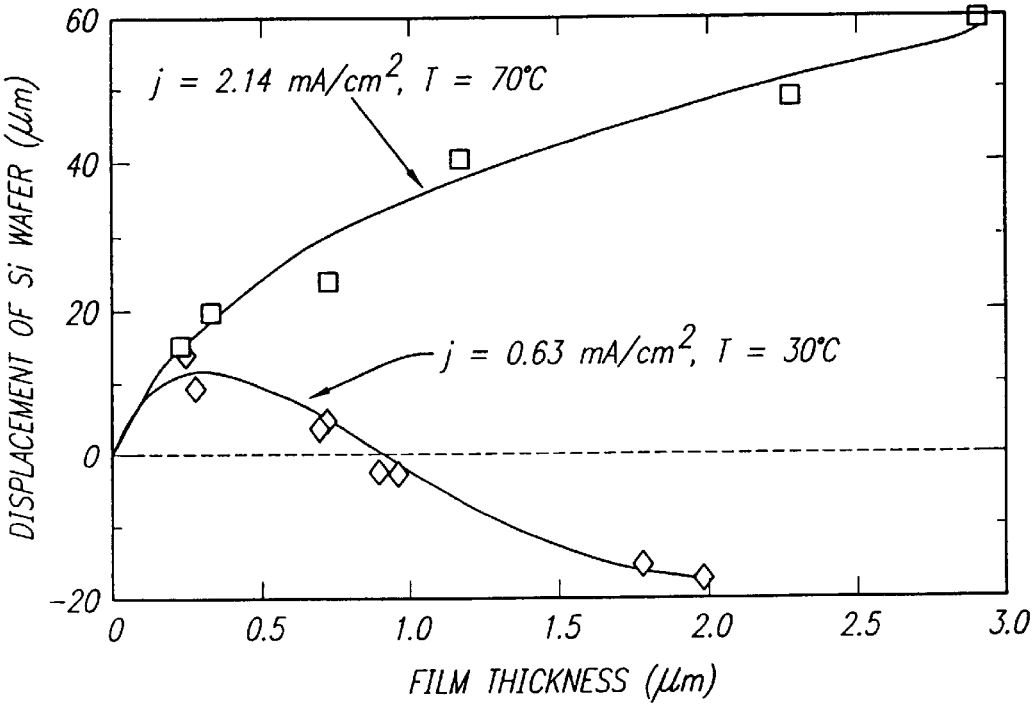
FIG. 8 is a graph of the experimental results of displacement of a silicon substrate vs. electroplated metal thickness using nickel as the plating material and silicon as the substrate according to the present invention.

In accordance with the Stoney equation, if the substrate displacement can be determined, one can calculate and determine the stress. The substrate displacement, and thus the stress, can be controlled via current density and temperature. FIG. 8 shows a plot of the substrate displacement versus the thickness of electroplated metal using two sets of parameters: 1) current density of 2.14 mA/cm$^2$ and temperature of 70° C. and 2) current density of 0.63 mA/cm $^2$ and temperature of 30° C.

Figure 9:
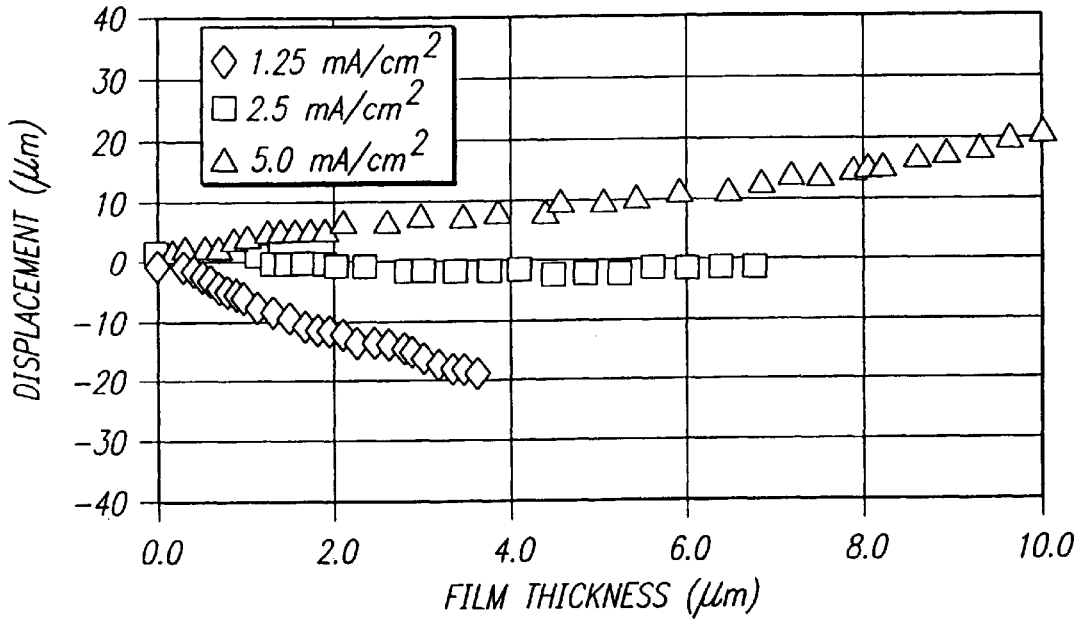
FIG. 9 is a graph of the experimental results of substrate displacement vs. electroplated metal thickness using three current densities: 1.25 $mA/cm^2$, 2.5 $mA/cm^2$, and 5.0 $mA/cm^2$.

FIG. 9 shows and example of controlling the displacement of a 3-inch silicon substrate in a test run. As exemplified in FIG. 9, when a current density of 2.5 mA/cm$^2$ and a plating temperature of 30° C. were utilized, a low displacement of the substrate was manifested throughout the entire plating process compared to plating run at the current densities of 1.25 mA/cm$^2$ and 5 mA/cm$^2$. For the plating process herein, the noise of the entire laser measurement system, including the temperature drift and the vibration of the substrate due to the agitation by the plating solution and air ventilation was about 1–2 um for the 3-inch wafer over a period of a few hours. FIG. 9 shows that the magnitude of the displacement was measured to be about 2–3 um, nearly the same as that induced by noise.

Figure 10:
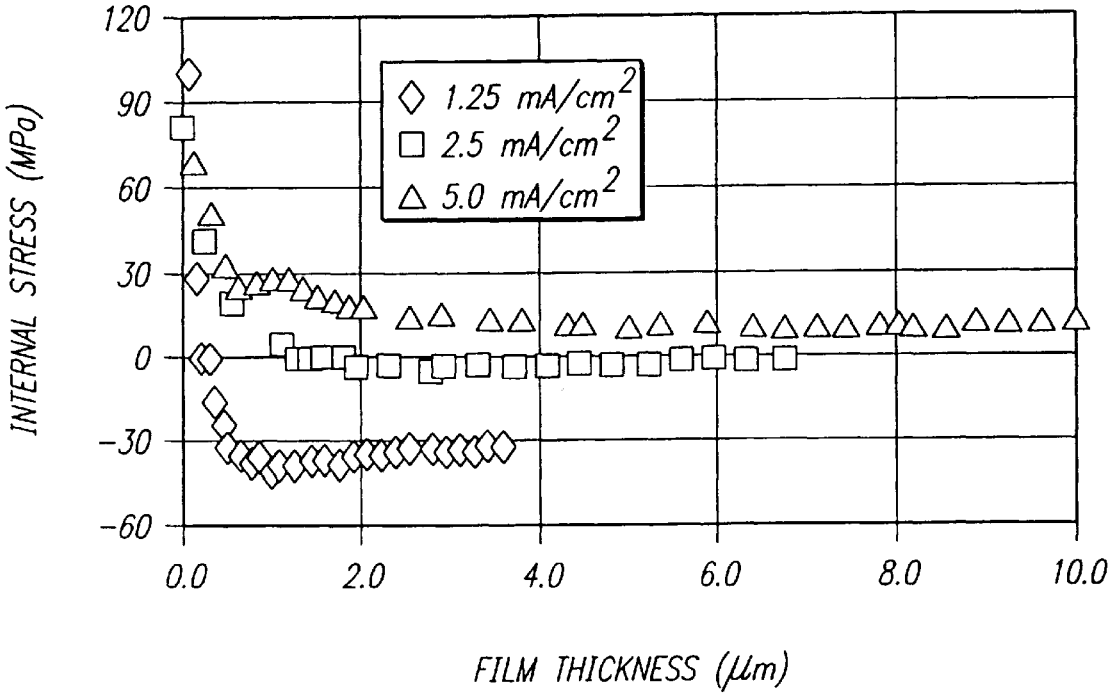
FIG. 10 is a graph of the experimental results of stress vs. electroplated metal thickness using 3 current densities: 1.25 $mA/cm^2$, 2.5 $mA/cm^2$, and 5.0 $mA/cm^2$.

In accordance with the data of FIG. 9, the corresponding stress was calculated and plotted in FIG. 10. As can be seen, a slightly high tensile stress occurred when the electroplated metal's thickness is less than 1 um. Thereafter, a near-zero stress state was obtained.

Although the present invention has been described in considerable detail with reference to certain preferred versions thereof, other versions are possible. For example, the closed-loop control system 18 can be configured to achieve a non-near null stress at the electroplated metal, as compared to a near null stress. Using the Closed-loop Current Density Controlled Method depicted in FIGS. 1 and 2, the closed-loop control system 18 processes the displacement data signal 24 and determines the stress level of the electroplated metal. Once the stress reaches a certain desirable level, the closed-loop control system 18 increases the current density 34 of the power supply 20 to the cathode 42 and the anode 44 to maintain the stress level at a constant.

Another method to achieve a non-near null stress at the electroplated metal is the Closed-loop Temperature Controlled Method. Using the Closed-loop Temperature Controlled Method depicted in FIGS. 1 and 3, the closed loop control system 18 processes the displacement data signal 24 and determines the stress level of the electroplated metal. Once the stress reaches a certain desirable level, the closed-loop control system 18 decreases the plating temperature to maintain the stress level at a constant.

Another method to achieve a non-near null stress at the electroplated metal is the Closed-loop Concurrent Current Density and Temperature Controlled Method. Using the Closed-loop Concurrent Current Density and Temperature Controlled Method depicted in FIGS. 1 and 4, the displacement sensor system 16 measures the displacement of the substrate 12 for electroplating and transmits displacement data signals 24 to the closed-loop control system 18. The displacement data signals 24 are processed by the closed-loop control system 18 and it determines whether the stress of the electroplated metal has reached a certain desirable level. If the stress of the electroplated metal has reached a certain desirable level, the closed-loop control system 18 increases the current density 34 to the cathode 42 and the anode 44 and lowers the plating temperature by transmitting power supply control signals 30 to the power supply 22 and temperature control system control signals 32 to the temperature control system 22 to maintain the desired stress at the electroplated metal.

INDUSTRIAL APPLICABILITY

The individual applicability of the current invention is primarily in the manufacturing of micro-electromechanical sensors ("MEMS"), where electroplating is a key step. Electroplating is also used in various microelectronics for military and commercial applications. Examples of military and commercial applications include microsensors such as accelerometers and gyroscopes for missiles and automotive applications.

Based on the above, the spirit and scope of the appended claims should not necessarily be limited to the description of the preferred versions contained herein.

What is claimed is:

1. A method for controlling electroplated film shrinkage or expansion relative to a substrate and resulting in substrate displacement, comprising the steps of;

disposing the substrate for electroplating with a cathode in a fountain plating system;

disposing a plating material with an anode in the fountain plating system;

disposing a plating solution in the fountain plating system;

maintaining the temperature of the fountain plating system at a constant level;

establishing a flow of current between a power supply, the cathode and the anode;

directly measuring a displacement of the substrate itself through a displacement sensor system so as to eliminate the need for a comparative measurement of a dummy part, the displacement occurring upon the flow of current resulting in an electroplated film on the substrate; and controlling the flow of current to the cathode and the anode in response to a displacement measurement of the substrate itself.

2. The method of claim 1, wherein the step of controlling the flow of current comprises:

generating displacement data signals by the displacement sensor system;

transmitting the displacement data signals to a closed-loop control system;

processing the displacement data signals by the closed-loop control system;

generating current density control signals by the closed-loop control system;

transmitting the current density control signals to the power supply; and adjusting the flow of current from the power supply in accordance with the current density control signals.

3. The method of claim 1 wherein said current flow between the cathode and anode is provided by the power supply.

4. A method for controlling electroplated film shrinkage or expansion relative to a substrate and resulting in substrate displacement, comprising the steps of:

disposing the substrate for electroplating with a cathode in a fountain plating system;

disposing a plating material with an anode in the fountain plating system;

disposing a plating solution in the fountain plating system;

establishing a flow of current between a power supply, the cathode and anode;

directly measuring a displacement of the substrate itself through a displacement sensor system so as to eliminate the need for a comparative measurement of a dummy part, the displacement occurring upon the flow of current resulting in an electroplated film on the substrate;

maintaining the flow of current at a constant level;

maintaining a constant current density between the cathode and the anode; and controlling the temperature of the fountain plating system through a temperature control system in response to a displacement measurement of the substrate itself.

5. The method of claim 4, wherein the step of controlling the temperature of the fountain plating system comprises:

generating displacement data signals by the displacement sensor system;

transmitting the displacement data signals to a closed-loop control system;

processing the displacement data signals by the closed-loop control system;

generating temperature control system control signals by the closed-loop control system;

transmitting the temperature control system control signals to the temperature control system; and adjusting the temperature of the fountain plating system by the temperature control system in accordance to the temperature control system control signals.

6. The method of claim 4 wherein the current flow between the cathode and anode is provided by the power supply.

7. A method for controlling electroplated film shrinkage or expansion relative to a substrate and resulting in substrate displacement, comprising the steps of:

disposing the substrate for electroplating with a cathode in a fountain plating system;

disposing a plating material with an anode in the fountain plating system;

disposing a plating solution in the fountain plating system;

establishing a flow of current between the cathode and anode;

directly measuring a displacement of the substrate itself through a displacement sensor system so as to eliminate the need for a comparative measurement of a dummy part, the displacement occurring upon the flow of current resulting in an electroplated film on the substrate;

controlling a flow of current to the cathode and the anode in response to displacement measurements of the substrate itself; and controlling a temperature inside the fountain plating system in response to the substrate displacement measurements.

8. The method of claim 7 wherein the current flow between the cathode and anode is provided by the power supply.

9. The method of claim 7, wherein the step of controlling the flow of current comprises:

generating displacement data signals by the displacement sensor system;

transmitting the displacement data signals to a closed-loop control system;

processing the displacement data signals by the closed-loop control system;

generating current density control signals by the closed-loop control system;

transmitting the current density control signals to the power supply; and adjusting the flow of current from the power supply in accordance with the current density control signals.

10. The method of claim 7, wherein the step of controlling the temperature inside the fountain plating system comprises:

generating displacement data signals by the displacement sensor system;

transmitting the displacement data signals to a closed-loop control system;

processing the displacement data signals by the closed-loop control system;

generating temperature control system control signals by the closed-loop control system;

transmitting the temperature control system control signals to a temperature control system; and adjusting the temperature of the fountain plating system by the temperature control system in accordance with the temperature control system control signals.

11. A method for controlling electroplated film shrinkage or expansion relative to a substrate and resulting in substrate displacement, comprising the steps of:

disposing the substrate for electroplating with a cathode in a fountain plating system;

disposing a plating material with an anode in the fountain plating system;

disposing a plating solution in the fountain plating system;

controlling the temperature of the fountain plating system at a constant level;

establishing a flow of current between a power supply, the cathode, and the anode;

directly measuring a displacement of the substrate itself through a displacement sensor system so as to eliminate the need for a comparative measurement of a dummy part, the displacement occurring upon the flow of current resulting in an electroplated film on the substrate; and controlling the flow of current to the cathode and the anode in response to a displacement measurement of the substrate itself.

* * * * *